US007580020B2

(12) United States Patent
Udo et al.

(10) Patent No.: US 7,580,020 B2
(45) Date of Patent: Aug. 25, 2009

(54) SEMICONDUCTOR DEVICE AND LIQUID CRYSTAL PANEL DRIVER DEVICE

(75) Inventors: Shinya Udo, Kawasaki (JP); Masao Kumagai, Kawasaki (JP); Masatoshi Kokubun, Kawasaki (JP); Hidekazu Nishizawa, Kawasaki (JP); Takeo Shigihara, Kawasaki (JP)

(73) Assignee: Fujitsu Microelectronics Limited, Tokyo (JP)

( * ) Notice: Subject to any disclaimer, the term of this patent is extended or adjusted under 35 U.S.C. 154(b) by 605 days.

(21) Appl. No.: 11/487,339

(22) Filed: Jul. 17, 2006

(65) Prior Publication Data

US 2006/0256052 A1 Nov. 16, 2006

Related U.S. Application Data

(62) Division of application No. 10/205,414, filed on Jul. 26, 2002, now Pat. No. 7,098,878.

(30) Foreign Application Priority Data

Nov. 29, 2001 (JP) ..... 2001-363617

(51) Int. Cl.
*G09G 3/34* (2006.01)

(52) U.S. Cl. ..... 345/87; 345/104; 345/204; 345/205; 324/763; 324/765; 324/770

(58) Field of Classification Search ..... 345/87, 345/104, 204, 205; 324/763, 765, 770
See application file for complete search history.

(56) References Cited

U.S. PATENT DOCUMENTS

| | | | | |
|---|---|---|---|---|
| 5,818,252 | A | 10/1998 | Fullman et al. | |
| 5,889,713 | A * | 3/1999 | Chan et al. | 365/201 |
| 5,981,971 | A | 11/1999 | Miyakawa | |
| 6,028,442 | A | 2/2000 | Lee et al. | |
| 6,304,241 | B1 | 10/2001 | Udo et al. | |
| 6,335,721 | B1 | 1/2002 | Jeong | |
| 2001/0014959 | A1 * | 8/2001 | Whetsel | 714/724 |
| 2003/0034941 | A1 | 2/2003 | Janssen et al. | |

FOREIGN PATENT DOCUMENTS

| | | | |
|---|---|---|---|
| JP | 03-127846 | A | 5/1991 |
| JP | 05-74898 | | 3/1993 |
| JP | 08-184646 | A | 7/1996 |

(Continued)

*Primary Examiner*—Bipin Shalwala
*Assistant Examiner*—Vince E Kovalick
(74) *Attorney, Agent, or Firm*—Arent Fox LLP

(57) ABSTRACT

A semiconductor device carries out a test utilizing contact with a probe needle without being affected by narrowing of the pitch at which output pads are arranged. The device is equipped with test circuits provided between a plurality of output buffers via which signals are output and output pads corresponding thereto. The test circuit includes output switches caused to sequentially make connections by a controller in test and interpad switches involved in making connections of the output pads with a test pad by the controller in test. In test, probe needles are brought into contact with the test pad. The output pads are not used in test, and can be arranged at a narrowed pitch. Thus, the chip area can be reduced and are therefore so that the pitch for the output pads can be narrowed and the chip area can be decreased.

8 Claims, 7 Drawing Sheets

FOREIGN PATENT DOCUMENTS

| | | | |
|---|---|---|---|
| JP | 08-248935 | A | 9/1996 |
| JP | 11-084420 | A | 3/1999 |
| JP | 11-149092 | A | 6/1999 |
| JP | 2000-056741 | A | 2/2000 |
| JP | 2000-208717 | A | 7/2000 |
| JP | 2000-315771 | A | 11/2000 |
| JP | 2001-056664 | A | 2/2001 |

* cited by examiner

SEMICONDUCTOR DEVICE AND LIQUID CRYSTAL PANEL DRIVER DEVICE

CROSS-REFERENCE TO RELATED APPLICATIONS

This application is Divisional Application, which claims the benefit of U.S. patent application Ser. No. 10/205,414, filed on Jul. 26, 2002 now U.S. Pat. No. 7,098,878. The disclosure of the prior application is hereby incorporated herein in its entirety by reference.

BACKGROUND OF THE INVENTION

1. Field of the Invention

The present invention relates to semiconductor devices, and more particularly, to a semiconductor device suitably applicable to an integrated circuit for driving a liquid crystal panel.

2. Description of the Related Art

Integrated circuit chips of manufactured semiconductor devices are tested in various ways. One of the tests is a function test that confirms whether an expected signal is available at an output terminal in response to a given signal applied to an input terminal. Generally, in the function test, connections with all pads used on the chip are made in a certain way.

FIG. 7 shows a conventional manner of testing semiconductor devices. Referring to FIG. 7, a plurality of pads 102 are formed around a circuit formation surface of a semiconductor chip 101. The pads 102 are connected to all terminals used as inputs, output and power supply of circuits formed on the semiconductor chip 101.

The function test of the semiconductor chip 101 is carried out in such a manner that probe needles 103 connected to a test device are contacted to all the pads 102 used. That is, input signals that are output from the test device are input to the pads 102 of the given input terminals of the semiconductor chip 101 via the probe needles 103, and the resultant signals that are output to the given output terminals are sent to the test device via the probe needles 103.

The number of pads 102 on the semiconductor chip 101 increases as the integration progresses. For example, a recent integrated circuit for driving a liquid crystal panel has output terminals as many as 384 outputs. Thus, the pitch of the pads 102 is narrowed and the pitch is now as narrow as 50 μm.

Recently, an increased number of terminals are required as the number of pixels increases due to progress to higher precision of the liquid crystal panel. It is estimated that the integrated circuit for driving the liquid crystal panel further progresses from the 384 outputs and has 480 or 512 outputs. The conventional pad pitch needs an increased chip area and raises the production cost. Therefore, there has been considerable activity in narrowing the pad pitch to thus reduce the chip area so that an increased number of outputs are realized at a low cost. The recent assembly technique goes toward a pad pitch as narrows as 45 μm and further 35 μm.

However, a new problem will arise from the narrowing of the pad pitch. More particularly, a difficulty in contacting pads with the probe needles will be encountered. It will become difficult to correctly make contact the pads with the probe needles due to the narrowing of the pad pitch. The adjacent pads may frequently be short-circuited. Further, it may be difficult to make an adjustment for cancellation of the difference in contact pressure among the pads due to the difference in height so as to have a uniform constant contact pressure on each pad because each of the all pads is contacted with the respective probe needle. The factors mentioned above will reduce the yield in mass production.

SUMMARY OF THE INVENTION

Taking into consideration the above, an object of the present invention is to provide a semiconductor device that can be tested using probe needles without being affected by narrowing of the pad arrangement pitch.

To accomplish the above object, there is provided a semiconductor device in which a plurality of output circuits and output pads corresponding to output terminals of the output circuit are arranged, said semiconductor device comprising: output switches provided in series between the output terminals of the output circuits and the output pads corresponding thereto; a test pad used in test; interpad switches provided between the output pads adjacent to each other and between the test pad and the output pad adjacent to the test pad; and controller controlling the output switches and the interpad switches.

According to another aspect of the present invention, there is provided a liquid crystal driver device equipped with a plurality of drive circuits for driving pixels of a liquid crystal panel and a plurality of output pads provided so as to correspond to output terminals of the drive circuits. The liquid crystal driver device includes: a test pad used in test; and a test circuit including output switches disconnecting the output terminals of the drive circuits and the output pads corresponding thereto in test, interpad switches connecting all the output pads and the test pad in test, and a controller sequentially making connections via the output switches in test.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

First, the outline of the present invention is described with reference to the accompanying drawings.

Figure 1:
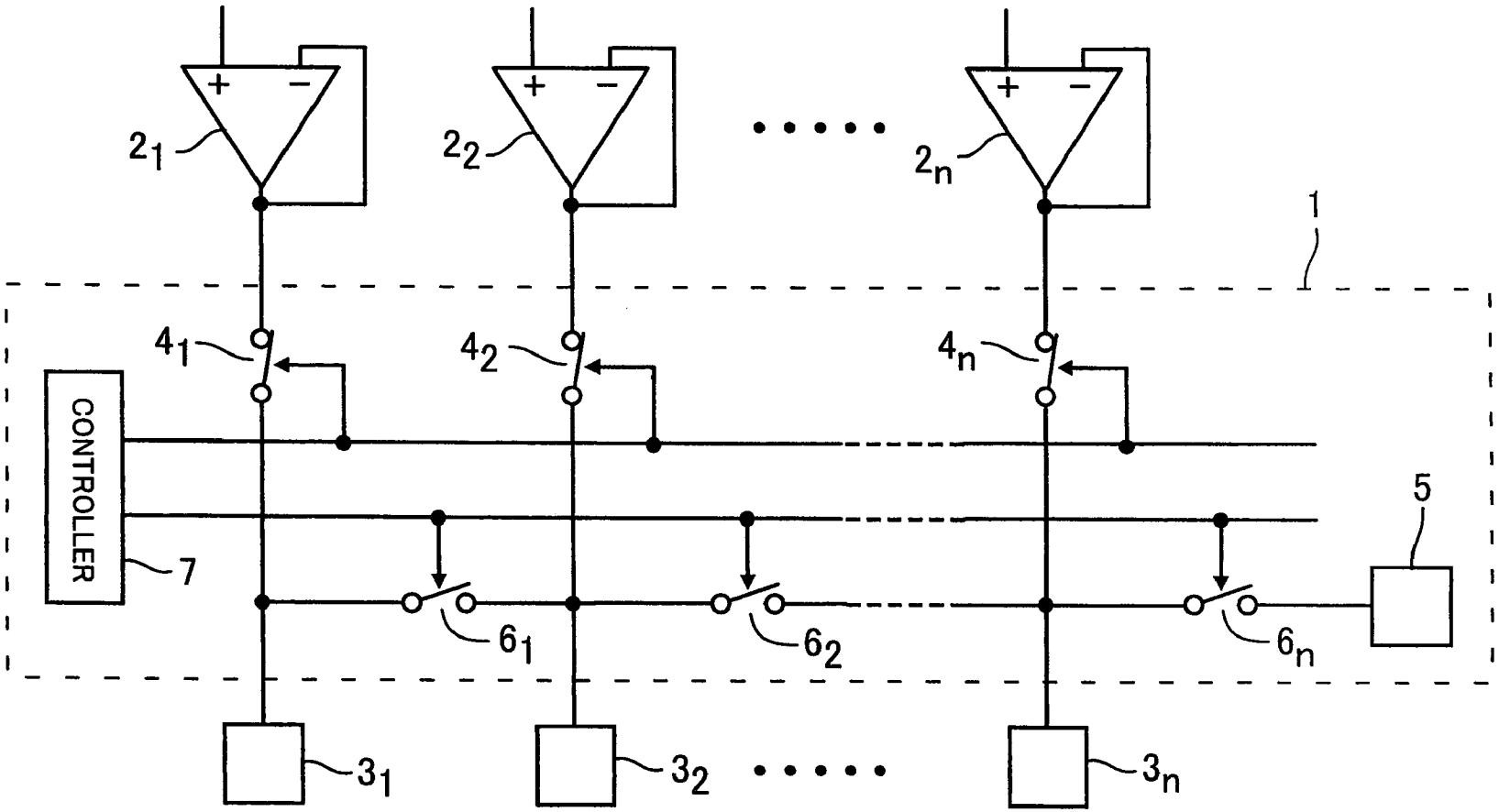
FIG. 1 is a diagram of the principal structure of a semiconductor device of the present invention.

FIG. 1 is a diagram showing the principle of the semiconductor device of the present invention.

The semiconductor device of the present invention is equipped with a test circuit 1 located at the stage following an output buffer that outputs a plurality of output signals. The test circuit 1 has output buffers $\mathbf{2}_1, \mathbf{2}_2, \ldots, \mathbf{2}_n$, output pads $\mathbf{3}_1, \mathbf{3}_2, \ldots, \mathbf{3}_n$, output switches $\mathbf{4}_1, \mathbf{4}_2, \ldots, \mathbf{4}_n$, a single test pad 5, interpad (pad-to-pad) switches $\mathbf{6}_1, \mathbf{6}_2, \ldots, \mathbf{6}_n$, and a controller 7. The output buffers $2_1, 2_2, \ldots, 2_n$ form respective output circuits. The output pads $3_1, 3_2, \ldots, 3_n$ are connected in series between the output pads $3_1, 3_2, \ldots, 3_n$ and the output buffers $2_1, 2_2, \ldots, 2_n$. The interpad switches $6_1, 6_2, \ldots, 6_n$ are provided between the adjacent pads $3_1, 3_2, \ldots, 3_n$ and between the output pad $3n$ and the test pad 5. The controller 7 controls the output switches $4_1, 4_2, \ldots, 4_n$ and the interpad switches $6_1, 6_2, \ldots, 6_n$.

In the semiconductor device with the above-mentioned test circuit 1, the function test is carried out as follows. On the signal input side, the probe pads are brought into contact with all the pads of the input terminals used in the test, and the test signals are input thereto. On the signal output side, only the test pad 5 is brought into contact with the probe needle, and all the output signals available at the output pads $3_1, 3_2, \ldots, 3_n$ are detected via the test pad 5.

In the function test, the controller 7 of the test circuit turn OFF all the output switches $4_1, 4_2, \ldots, 4_n$, and simultaneously, turns ON all the interpad switches $6_1, 6_2, \ldots, 6_n$.

Nest, the controller 7 sequentially turns ON one of the output switches $4_1, 4_2, \ldots, 4_n$. More particularly, the controller 7 initially turns ON only the output switch $4_1$. Thus, the output of the output buffer $2_1$ is electrically connected to the test pad 5 via the output switch $4_1$ and all the interpad switches $6_1, 6_2, \ldots, 6_n$. Then, the output signal of the output buffer $2_1$ is output to the test pad 5. Next, the first output switch $4_1$ is turned OFF and only the second output switch $4_2$ is turned ON. This connects the output of the output buffer $2_2$ to the test pad 5 via the output switch $4_2$ and the interpad switch $6_2, \ldots, 6_n$. Then, the output signal of the output buffer $2_2$ is output to the test pad 5. In the above manner, one of the output switches $4_1, 4_2, \ldots, 4_n$ is sequentially turned ON, so that the output signals of the output buffers $2_1, 2_2, \ldots, 2_n$ can be sequentially output to the test pad 5 one by one. Then, the output signal available at the test pad 5 is monitored via the single probe needle, so that the outputs of all the output buffers $2_1, 2_2, \ldots, 2_n$ can be tested.

A description will now be given of an embodiment of the present invention applied to an integrated circuit for driving the liquid crystal panel.

Figure 2:
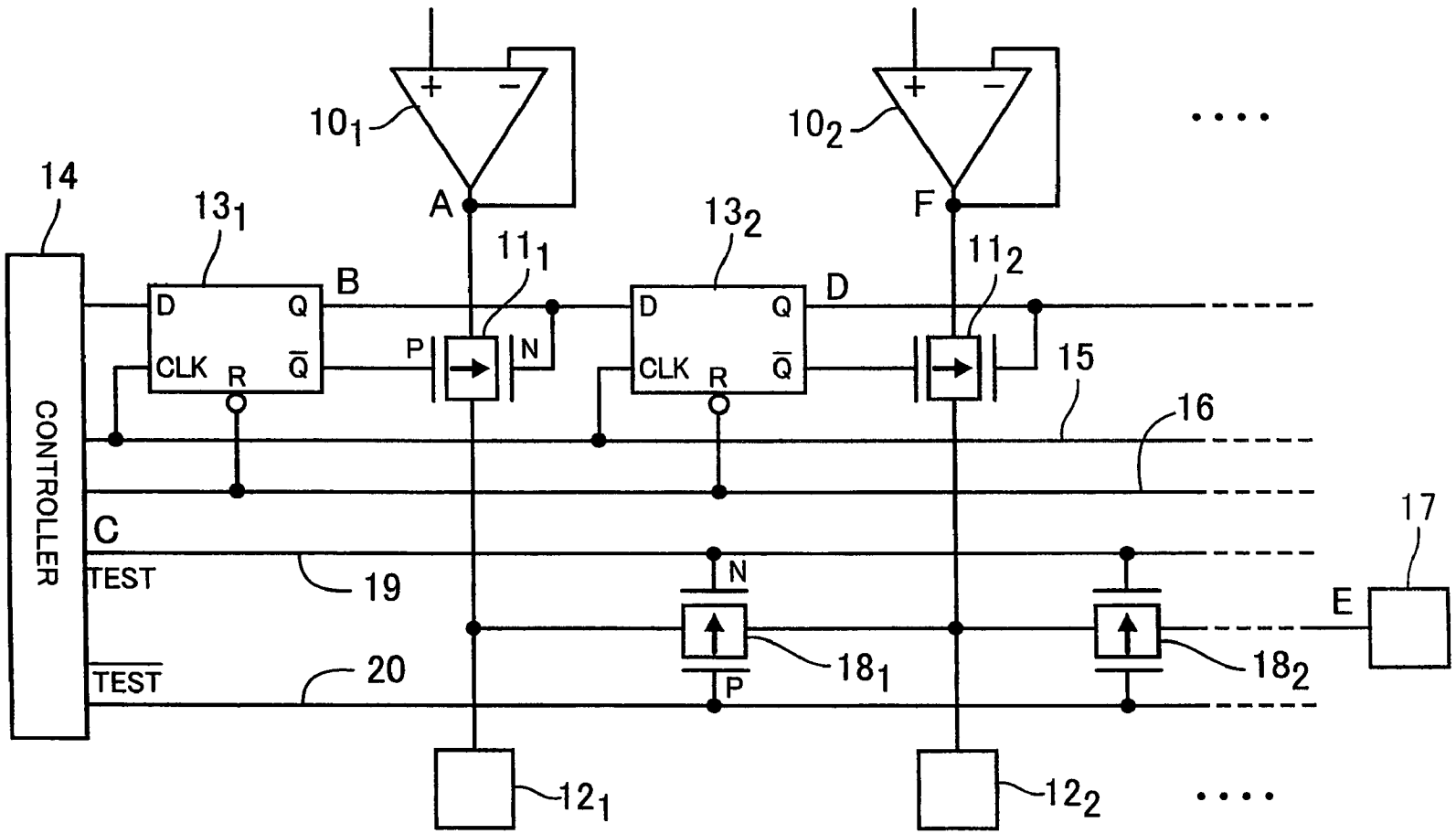
FIG. 2 is a diagram of a part of the structure of a test circuit according to a first embodiment of the present invention.
Figure 3:
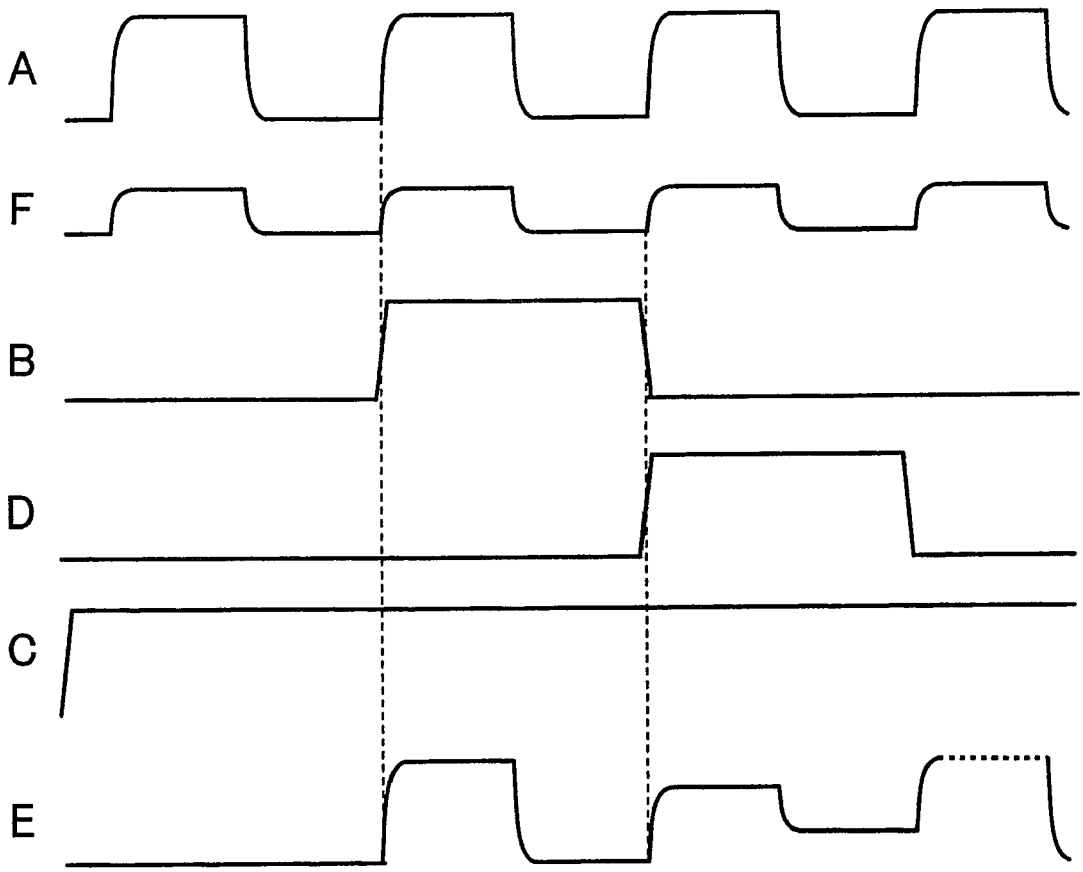
FIG. 3 is a waveform diagram of signals observed in the circuit shown in FIG. 2.

FIG. 2 is a circuit diagram that partially illustrates a structure of the test circuit according to the first embodiment of the present invention, and FIG. 3 is a waveform diagram of signals observed in the circuit shown in FIG. 2.

An integrated circuit called a source driver or data driver, and another integrated circuit called a gate driver are connected to the liquid crystal panel. The circuit shown in FIG. 2 is a part of the data driver. The final stage of the data driver is an output circuit that supplies each pixel of the liquid crystal panel with an image voltage. The output circuit is composed of a plurality of operational amplifiers $10_1, 10_2, \ldots$ provided to the respective pixels. The output terminals of the operational amplifiers $10_1, 10_2, \ldots$ are connected to output pads $12_1, 12_2, \ldots$ via transfer gates $11_1, 11_2, \ldots$. Each of the transfer gates $11_1, 11_2, \ldots$ is made up of a P-channel MOS transistor and an N-channel MOS transistor. Each transfer gate functions as a switch that operates as follows. Each transfer gate is turned OFF when a high-level voltage is applied to the gate terminal of the P-channel MOS transistor, and a low-level voltage is applied to the gate terminal of the N-channel MOS transistor. Each transfer gate is turned ON when the low-level voltage is applied to the gate terminal of the P-channel MOS transistor and the high-level voltage is applied to the gate terminal of the N-channel MOS transistor.

The gate terminals of the transfer gates $11_1, 11_2, \ldots$ on the N-channel side are connected to non-inverting output terminals of flip-flops $13_1, 13_2, \ldots$, and the gate terminals thereof on the P-channel side are connected to inverting output terminals. A data input terminal (D) of the flip-flop $13_1$ is connected to the controller 14, and the non-inverting output terminal thereof is connected to a data input terminal of the next flip-flop $13_2$. Similarly, the non-inverting output terminal of the flip-flop $13_2$ is connected to the data input terminal of the next flip-flop. In the above-mentioned manner, the plurality of flip-flops $13_1, 13_2, \ldots$ are cascaded. Clock input terminals (CLK) and a reset input terminal (R) of the flip-flops $13_1, 13_2, \ldots$ are connected to a clock line 15 and a reset line 16 both connected to the controller 14.

Transfer gates $18_1, 18_2, \ldots$ that have switching functions are connected between the adjacent output pads $12_1, 12_2, \ldots$ and the output pad arranged at the final stage of the output circuit and a test pad 17. Each of the transfer gates is made up of a P-channel MOS transistor and an N-channel MOS transistor. The gate terminals of the transfer gates $18_1, 18_2, \ldots$ on the N-channel side are connected to a test line 19 on which a non-inverting test signal travels, and gate terminals thereof on the P-channel side are connected to a test line 20 on which an inverting test signal travels.

A description will now be given of an operation of the test circuit with reference to FIG. 3.

It is assumed that gradation voltage signals A and F that have levels corresponding to an image signal applied for test use are available at the output terminals of the operational amplifiers $10_1, 10_2, \ldots$. First, the controller 14 outputs the reset signal to the reset line 16 to thereby reset all the flip-flops $13_1, 13_2, \ldots$ and to turn OFF all the transfer gates $11_1, 11_2, \ldots$, so that all the outputs of the operational amplifiers $10_1, 10_2, \ldots$ are in the high-impedance state. Next, the controller 14 outputs a high-level voltage C and a low-level voltage to the test lines 19 and 20, respectively, so that all the transfer gates $18_1, 18_2$, are in the ON state.

Then, the controller 14 outputs a clock signal to the clock line 15. The first flip-flop $13_1$ latches high-level data output to the controller 14 via the data input terminal in synchronism with the clock signal, and outputs data B at the high level and data at the low level to the non-inverting and inverting output terminals, respectively. Thus, the transfer gate $11_1$ is turned ON, and the gradation voltage signal A of the operational amplifier $10_1$ is output to the output pad $12_1$. The gradation voltage signal A is output, as an output signal E, to the test pad 17 via all the transfer gates $18_1, 18_2, \ldots$.

During that time, the data that is being output to the flip-flop $13_1$ from the controller 14 is switched to the low level. The flip-flop $13_1$ latches data at the low level in synchronism with the next clock signal, and sets data B of the non-inverting output terminal to the low level, setting data of the inverting output terminal to the high level. Simultaneously, the second flip-flop $13_2$ latches the data at the high level being output to the non-inverting output terminal of the first flip-flop $13_1$, and outputs data D at the high level to the non-inverting output terminal, outputting data at the low level to the inverting output terminal. Thus, the transfer gate $11_1$ is turned OFF, and cuts off the gradation voltage signal A of the operational amplifier $10_1$. Simultaneously, the transfer gate $11_2$ is switched to ON, and outputs a gradation voltage signal F of the operational amplifier $10_2$ to the output pad $12_2$. The gradation voltage signal F is output, as an output signal E, to the test pad 17 via the transfer gates $18_2, \ldots$.

Hereinafter, similarly, the third flip-flop and the remaining flip-flop sequentially latch the output of the previous stage, so that the third transfer gate and the remaining transfer gates are sequentially turned ON. Thus, the outputs of the operational amplifiers are sequentially output to the test pad 17 one by one. This makes it possible to test all the outputs of the output circuit of the data driver by merely bringing the probe needle to only the test pad 17 without being short-circuited.

Figure 4:
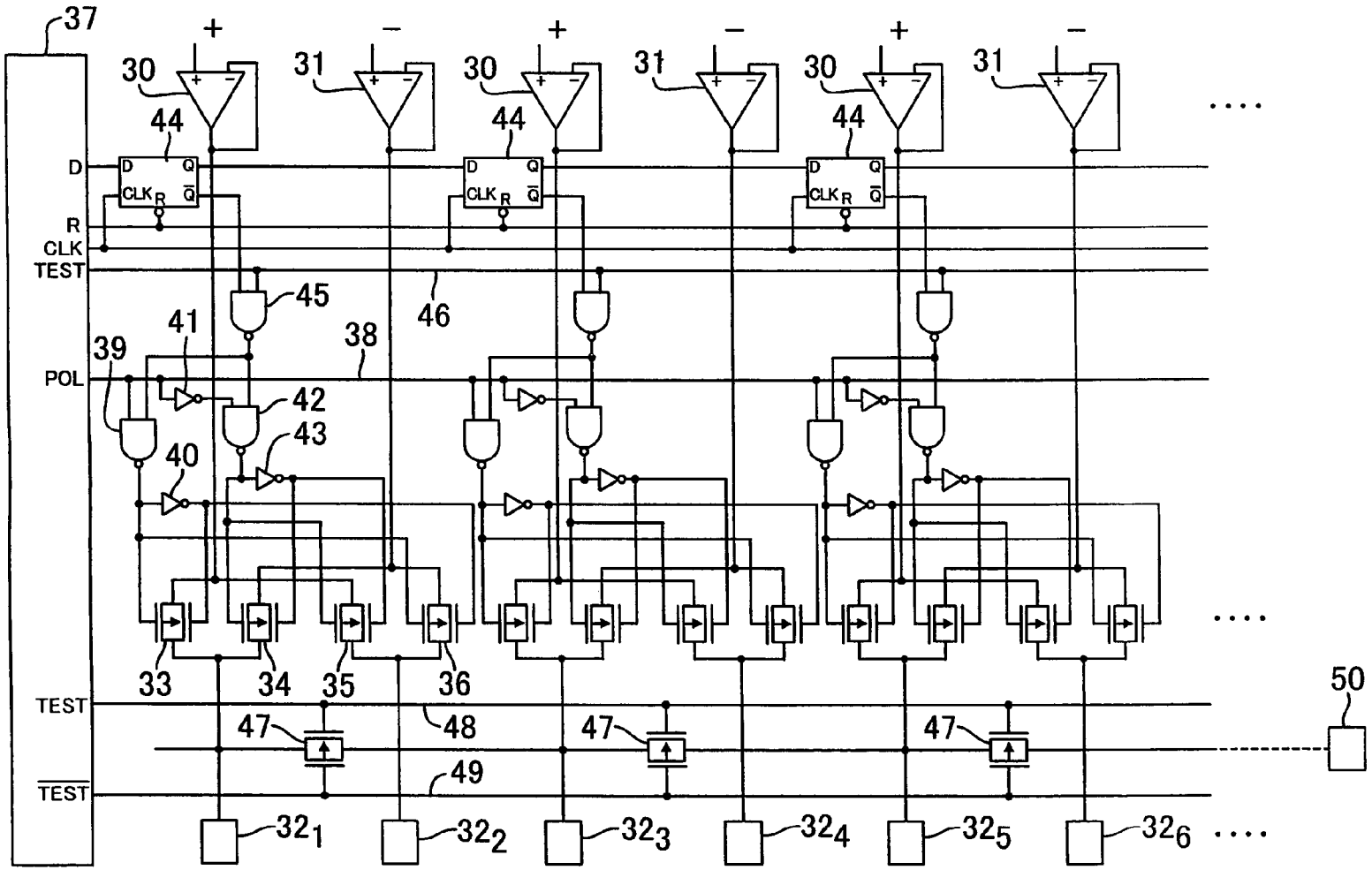
FIG. 4 is a diagram of a part of the structure of a test circuit according to a second embodiment of the present invention.

FIG. 4 is a circuit diagram that partially shows a structure of the test circuit according to a second embodiment of the present invention. The test circuit utilizes a part of the circuit that forms the data driver as a transfer gate that cuts off the operational amplifier that is not to be measured. More particularly, a data driver that drives a liquid crystal panel into which a liquid crystal and a TFT (Thin Film Transistor) are combined a positive-polarity system, a negative-polarity system and a polarity reversing circuit because such a data driver is required to alternately output the gradation voltage positive to the common voltage and the gradation voltage negative thereto. The polarity reversing circuit is utilized as a switch that cuts off the output of the operational amplifier that is not to be measured.

In FIG. 4, an operational amplifier 30 which outputs a gradation voltage of the positive polarity and an operational amplifier 31 which outputs a gradation voltage of the negative polarity are paired, and a plurality of such pairs are provided. The output terminals of the pairs of operational amplifiers are connected to output pads $\mathbf{32}_1$, $\mathbf{32}_2$, $\mathbf{32}_3$, $\mathbf{32}_4$, $\mathbf{32}_5$, $\mathbf{32}_6$, . . . via the polarity reversing circuits. Each of the polarity reversing circuits is made up of four transfer gates 33, 34, 35 and 36, each of which transfer gates is made up of a P-channel MOS transistor and an N-channel MOS transistor. The output terminals of the operational amplifiers 30 are connected to odd-numbered output pads $\mathbf{32}_1$, $\mathbf{32}_3$, $\mathbf{32}_5$, . . . via the transfer gates 33, and are connected to even-numbered output pads $\mathbf{32}_2$, $\mathbf{32}_4$, $\mathbf{32}_6$, . . . via the transfer gates 35. The output terminals of the operational amplifiers 31 are connected to the odd-numbered output pads $\mathbf{32}_1$, $\mathbf{32}_3$, $\mathbf{32}_5$, . . . via the transfer gates 34, and are connected to even-numbered output pads $\mathbf{32}_2$, $\mathbf{32}_4$, $\mathbf{32}_6$, . . . via the transfer gates 36.

A terminal of the controller 37 via which a polarity switching signal POL is connected to a switching control line 38, which is connected to first input terminals of NAND gates 39. The output terminals of the NAND gates 39 are connected to the gate terminals of the transfer gates 33 and 36 on the P-channel side and input terminals of inverters (NOT gates) 40. The output terminals of the inverters 40 are connected to the gate terminals of the transfer gates 33 and 36 on the N-channel side. The switching control line 38 is connected to the first input terminals of the NAND gates 42 via the inverters 41. The output terminals of the NAND gates 42 are connected to the gate terminals of the transfer gates 34 and 35 on the P-channel side and the input terminals of the inverters 43. The output terminals of the inverters 43 are connected to the gate terminals of the transfer gates 34 and 35 on the N-channel side.

The controller 37 has a data output terminal, a clock signal output terminal and a reset signal output terminal, these terminals being connected to flip-flops 44. The flip-flops 44 are cascaded so that the non-inverting output terminals thereof are connected to data input terminals of the next-stage flip-flops 44. The inverting output terminals of the flip-flops 44 are connected to the first input terminals of the NAND gates 45. The second input terminals of the NAND gates 45 are connected to a test line 46 via which the non-inverting test signal from the controller 37 is transferred. The output terminals of the NAND gates 45 are connected to the second input terminals of the NAND gates 39 and 42.

Transfer gates 47 are connected between the odd-numbered output parts $\mathbf{32}_1$, $\mathbf{32}_3$, $\mathbf{32}_5$, . . . and the gate terminals thereof on the N-channel side are connected to a test line 48 via which the non-inverting test signal from the controller 37 is output. The gate terminals of the transfer gates 47 on the P-channel side are connected to a test line 49 via which the inverting signal from the controller 37 is transferred. The transfer gate 47 of the final stage is connected to a test pad 50.

An operation of the test circuit in the data driver is described.

The controller 37 resets all the flip-flops 44. At that time, the controller 37 outputs a low-level voltage to the test lines 46, 48 and 49 and the switching control line 38. Thus, the high-level voltages are output via the output terminals of the NAND gates 45 and 39, and the low-level voltages are output via the output terminals of the NAND gates 42. Thus, the transfer gates 33 and 36 are OFF, while the transfer gates 34 and 35 are ON.

When the controller 37 outputs the test signal that is at the high level, the low-level voltages are output via the output terminals of all the NAND gates 45, and the high-level voltages are output via the output terminals of the NAND gates 39 and 42. Thus, all the transfer gates 33, 34, 35 and 36 of the polarity reversing circuit are OFF, and all the transfer gates 47 connected to the odd-numbered output pads $\mathbf{32}_1$, $\mathbf{32}_3$, $\mathbf{32}_5$ and the test pad 50 are ON.

Next, when the first flip-flop 44 latches high-level data that is output from the controller 37 in synchronism with the clock signal, the low-level voltage is output via the inverting output terminal thereof. Simultaneously, the controller 37 outputs the polarity switching signal POL at the high level. This causes the transfer gates 33 and 36 of the polarity reversing circuit to be ON while causing the transfer gates 34 and 35 thereof to be OFF. Thus, the output of the operational amplifier that outputs the gradation voltage of the positive polarity are connected to the test pad 50 via the transfer gates 33 and 47, so that the gradation voltage of the positive polarity can be output to the test pad 50.

Then, when the controller 37 outputs the polarity reversing signal POL of the low level, the states of the output terminals of the NAND gates 39 and 42 are reversed. Therefore, in turn, the transfer gates 33 and 36 of the polarity reversing circuit are OFF, while the transfer gates 34 and 35 are ON. Thus, the output of the operational amplifier 31 that outputs the gradation voltage of the negative polarity is connected to the test pad 50 via the transfer gates 34 and 47, so that the gradation voltage of the negative polarity can be output to the test pad 50.

The above-mentioned operation after the test signal is output is performed so that the output status of the flip-flop 44 is serially changed in synchronism with the clock signal. Thus, it is possible to output the gradation voltages of the positive and negative polarities to the test pad 50.

Figure 5:
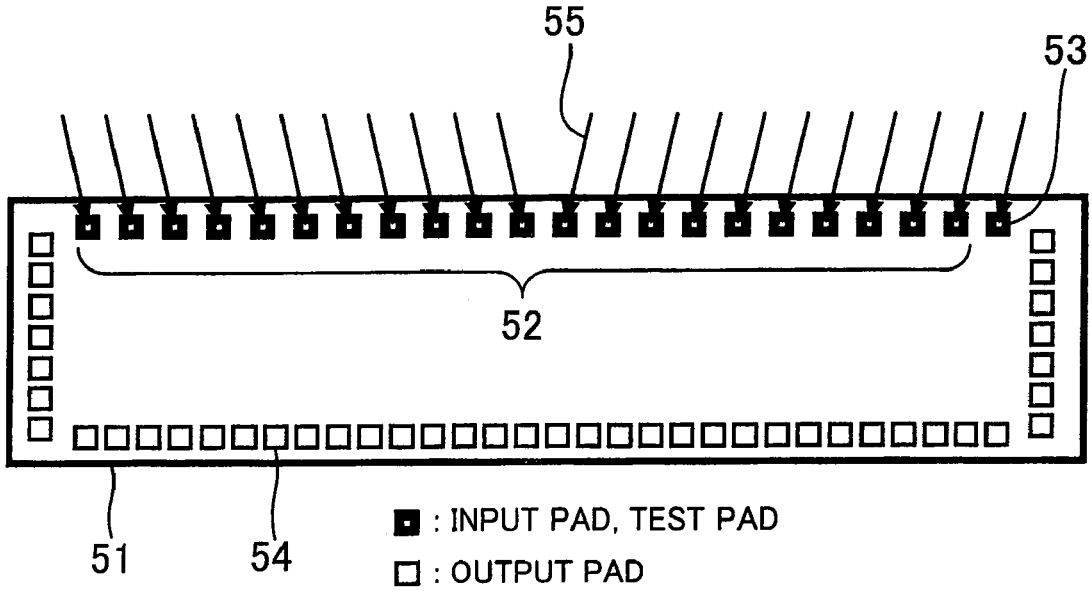
FIG. 5 is a conceptual diagram of pad formation surface of an integrated circuit for a data driver.

FIG. 5 is a conceptual view of a pad formation surface of an integrated circuit for the data driver.

An integrated circuit 51 has a pad arrangement in which pads for inputting and outputting are arranged along the sides of the shape thereof. In the example shown in FIG. 5, input pads 52 and a test pad 53 are arranged along a side of the integrated circuit 51, while output pads 54 are arranged along the remaining three sides. At the time of testing, the input pads 52 and the test pad 53 to which probe needles 55 are to be contacted are arranged at a pitch approximately equal to the conventional pitch so that no problem will be encountered at the time of contacting the probe needles 55. In contrast, the output pads 54 are arranged at a narrower pitch because the output pads 54 are not brought into contact with the probe needles 55.

In the conceptual example, the output signals that are output to all the output pads 54 are tested by the single test pad 53. However, for a data driver with 384 outputs, for example, all the outputs cannot be efficiently tested using only the single test pad 53. In practice, the output pads 54 are divided into some groups for each of which groups the single test pad 53 is provided. Preferably, when 384 output pads 54 are provided, the single output pad 54 is provided for the 48 output pads. In total, eight test pads 53 are provided for the 384 output pads 54, and are arranged in the same line as the input pads 52. The function test is simultaneously carried out for every group, so that the time necessary to carry out the function test can be reduced.

In the example illustrated, one side of the integrated circuit 51 is occupied by the input pads 52 and the test pad 53. Alternatively, part of the side may be used to dispose the output pads 54.

Figure 6:
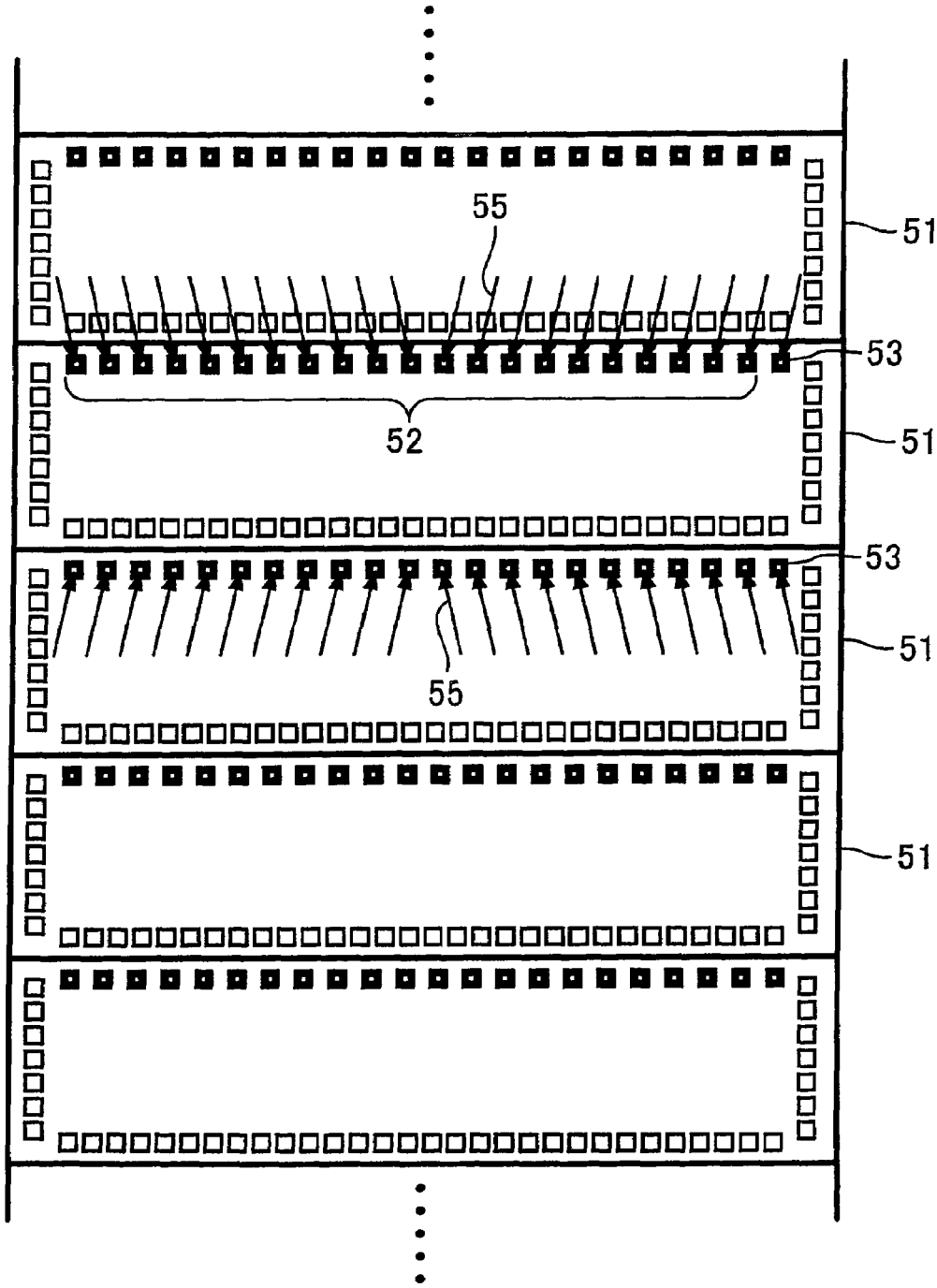
FIG. 6 is a view showing how the integrated circuit of the data driver is tested.
Figure 7:
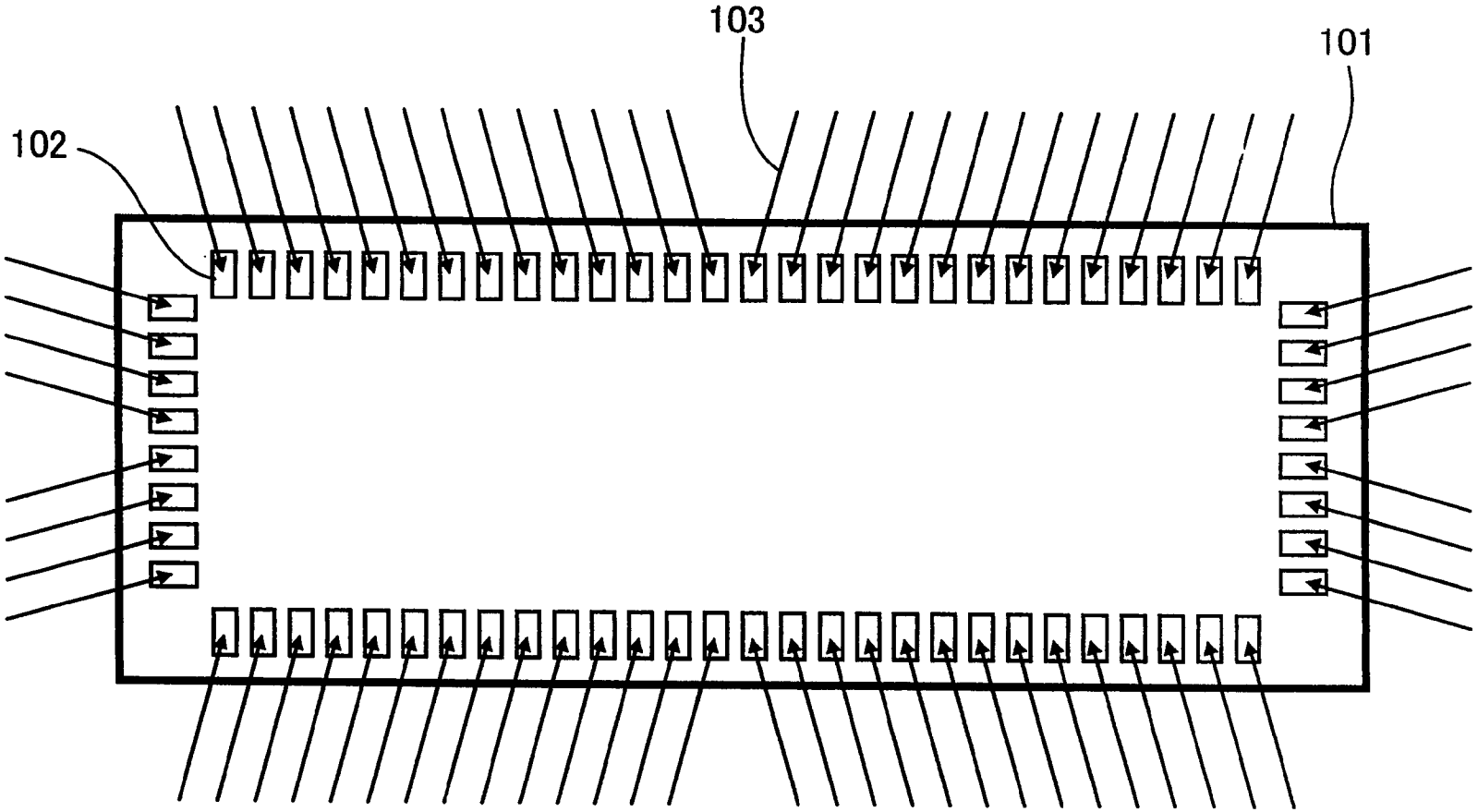
FIG. 7 PRIOR ART
FIG. 7 is a view of a conventional manner of testing a semiconductor device.

FIG. 6 is a view that explains how the integrated circuit for the data driver is tested.

For the integrated circuit for the data driver with multiple outputs, conventionally, the probe needles are contacted to the input and output pads along the four sides thereof. In contrast, the input pads and the test pad are arranged along the same side. Therefore, two integrated circuits can be simultaneously tested with the conventional test device.

A plurality of integrated circuits 512 are arranged side by side and are transported. In the test positions, every the integrated circuits 51 are fixed in given positions every two circuits, and probe needles 55 arranged in two lines for the input pads 52 and the test pads 53 of the integrated circuit can be contacted and detached simultaneously.

In test, the probe needles 55 are brought into contact with a small number of input pads 52 and the test pad 53. Thus, it is possible to easily adjust the contract pressure and achieve stable contacts. Further, two integrated circuits 51 are simultaneously tested, so that the time necessary for positioning the probe needles and the test time can be reduced.

As described above, according to the present invention, the voltages that appear on the output pads can be sequentially output to the single test pad. The test can be carried out using the test pad rather than the output pads, it is possible to reduce the pitch without being restricted by the pitch at which the output pads are arranged. Such narrowing the pitch contributes to reducing the chip area and the cost.

Further, according to the present invention, the test can be carried out with a number of contacts with the input pads and test pad, so that the contact pressure with which the probe needles are contracted can easily be adjusted and sure contacts can be made.

Furthermore, according to the present invention, the input pads used in the test and the test pad are arranged in line, so that the probe needles can be positioned with a reduced time. In addition, two adjacent integrated circuits can be tested simultaneously, so that the test can be carried out with a reduced time and the cost can be reduced.

The foregoing is considered as illustrate only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A semiconductor device in which a plurality of output circuits and output pads corresponding to output terminals of the output circuit are arranged, said semiconductor device comprising:

output switches provided in series between the output terminals of the output circuits and the output pads corresponding thereto;

a test pad used in test;

interpad switches provided between the output pads adjacent to each other and between the test pad and the output pad adjacent to the test pad; and a controller controlling the output switches and the interpad switches.

2. The semiconductor device according to claim 1, wherein the output switches and the interpad switches include transfer gates.

3. The semiconductor device according to claim 1, wherein in test, the controller controls all the interpad switches to ON and sequentially controls the output switches to ON so that output signals of the output circuits can be sequentially output to the test pad.

4. The semiconductor device according to claim 1, wherein all the output circuits and the output pads corresponding thereto are divided into a plurality of groups, and each of the plurality of groups is provided with a single test pad.

5. The semiconductor device according to claim 4, wherein the controller simultaneously tests the plurality of groups.

6. The semiconductor device according to claim 1, wherein the test pad is arranged in line in which the input pads used in test are arranged.

7. The semiconductor device according to claim 6, wherein the output pads are arranged at a pitch narrower than that at which the input pads used in test and the test pad are arranged.

8. The semiconductor device according to claim 1, wherein the output circuit is a drive circuit that supplies image voltages to pixels of a liquid crystal panel.

* * * * *